US008640477B1

(12) United States Patent
Merideth

(10) Patent No.: US 8,640,477 B1
(45) Date of Patent: Feb. 4, 2014

(54) HOLD-DOWN BRACKET FOR SECURING AN AIR CONDITIONER TO A ROOF MOUNTED AIR CONDITIONER SUPPORT

(75) Inventor: Mark Ray Merideth, Roseville, CA (US)

(73) Assignee: Uni-Products, Inc., North Highlands, CA (US)

( * ) Notice: Subject to any disclaimer, the term of this patent is extended or adjusted under 35 U.S.C. 154(b) by 1007 days.

(21) Appl. No.: 12/660,791

(22) Filed: Mar. 4, 2010

(51) Int. Cl.
*F25D 23/00* (2006.01)
*F25D 19/00* (2006.01)

(52) U.S. Cl.
USPC ..... 62/259.1; 62/298

(58) Field of Classification Search
USPC ..... 62/259.1, 298, 465, 466, 295; 165/79; 248/676, 544, 645, 649, 674–675, 300, 248/680, 536; 52/27
See application file for complete search history.

(56) References Cited

U.S. PATENT DOCUMENTS 5,687,514 A * 11/1997 Gillispie ..... 52/58
6,152,204 A * 11/2000 Santoro ..... 160/38
7,059,086 B2 * 6/2006 Edvardsen ..... 52/58

* cited by examiner

*Primary Examiner* — Cassey D Bauer
(74) *Attorney, Agent, or Firm* — Thomas R. Lampe

(57) ABSTRACT

A hold-down bracket employed to secure an air conditioner to a roof mounted air conditioner support includes two bracket members which are adjustable relative to one another, one bracket member secured to the frame of the support and the other bracket member secured to the air conditioner.

7 Claims, 3 Drawing Sheets

HOLD-DOWN BRACKET FOR SECURING AN AIR CONDITIONER TO A ROOF MOUNTED AIR CONDITIONER SUPPORT

TECHNICAL FIELD

This invention relates to an air conditioner support system and more particularly to a system employing a hold-down bracket for securing an air conditioner to a roof mounted air conditioner support.

BACKGROUND OF THE INVENTION

It is well known to utilize hold-down brackets to secure air conditioners to roof mounted air conditioner supports, the latter also commonly known as roof jacks and roof curbs. The brackets are also known as seismic clips since they are utilized to maintain the interconnection between the air conditioner and the air conditioner support even during earthquakes.

Conventional hold-down brackets are of single-piece, non-adjustable construction. This becomes a problem because a number of different sizes of air conditioners and air conditioner supports exist and it is necessary to maintain an inventory of numerous sizes of hold-down brackets to adapt to the particular air conditioners and air conditioner supports employed.

DISCLOSURE OF INVENTION

The present invention relates to an adjustable hold-down bracket which can be utilized with many different sizes of roof mounted air conditioner supports and air conditioners. The hold-down bracket of the present invention is readily adjustable at a work site at the time of installation. The installed hold-down bracket, once installed, provides a secure interconnection between an air conditioner and a roof mounted air conditioner support.

The hold-down bracket of the present invention is attachable to the frame of a roof mounted air conditioner support for securing an air conditioner to the frame.

The hold-down bracket includes a first bracket member for securement to the frame, the first bracket member including a first bracket member flange.

The bracket also incorporates a second bracket member for securement to the air conditioner and includes a second bracket member flange. The second bracket member flange engages the first bracket member flange and is slidably adjustable relative to the first bracket member flange. The first bracket member and the second bracket member jointly define an air conditioner receiving space for receiving a portion of the air conditioner.

Mechanical fasteners are employed to secure the first bracket member to the frame and to secure the second bracket member to the air conditioner.

Other features, advantages and objects of the present invention will become apparent with reference to the following description and accompanying drawings.

BEST MODE FOR CARRYING OUT THE INVENTION

Figure 1:
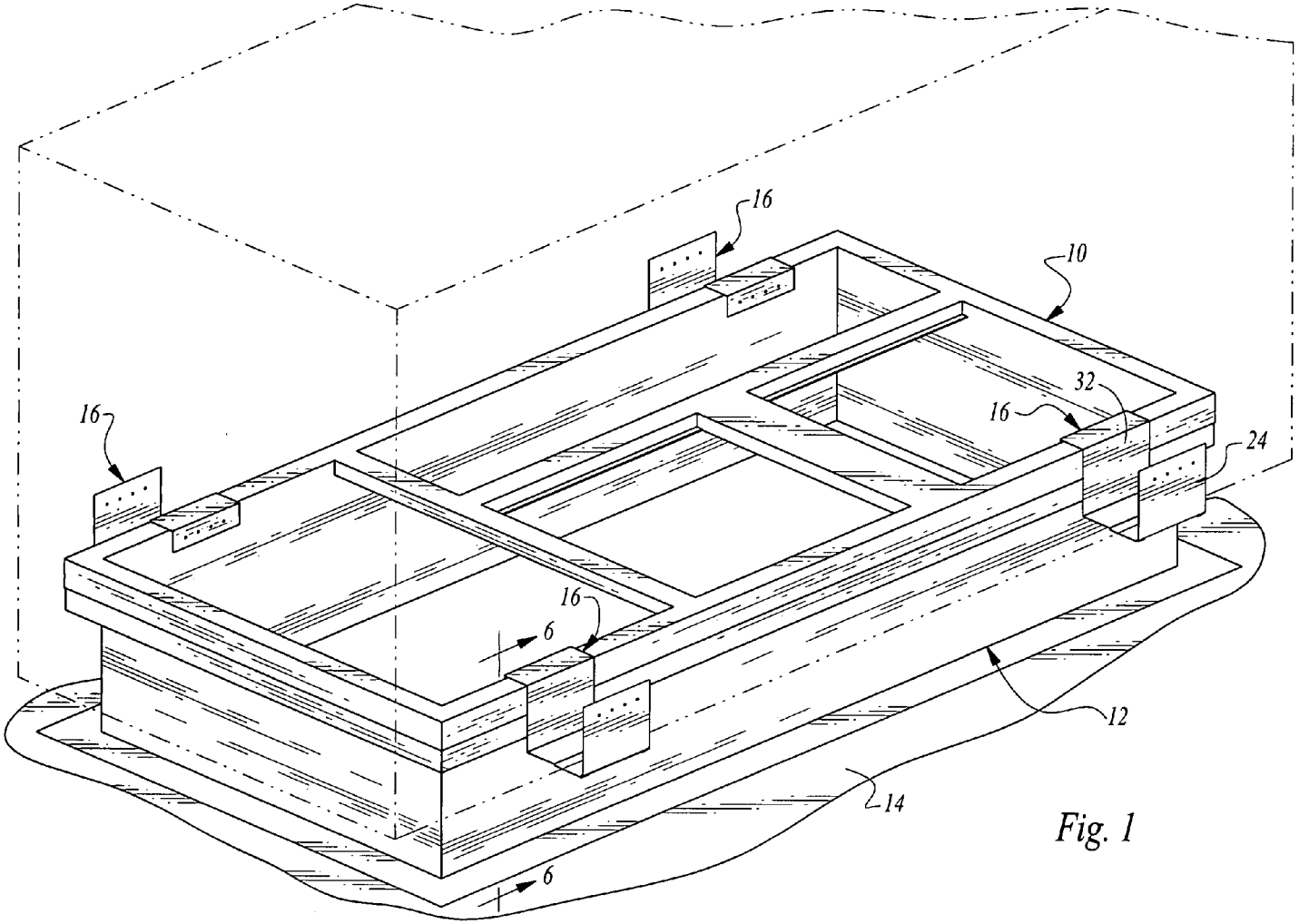
FIG. 1 is a perspective view illustrating a roof mounted air conditioner support of conventional construction having four hold-down brackets constructed in accordance with the teachings of the present invention attached thereto, an air conditioner being depicted by broken line in place on the support and hold-down brackets.

FIG. 1 illustrates a conventional roof mounted air conditioner support 10 having a frame 12 positioned on a building roof 14. Roof mounted air conditioner supports come in a wide variety of sizes as do the air conditioners themselves. FIG. 1 illustrates four hold-down brackets constructed in accordance with the teachings of the present invention positioned on the support, the hold-down brackets being designated by reference numeral 16.

Figure 2:
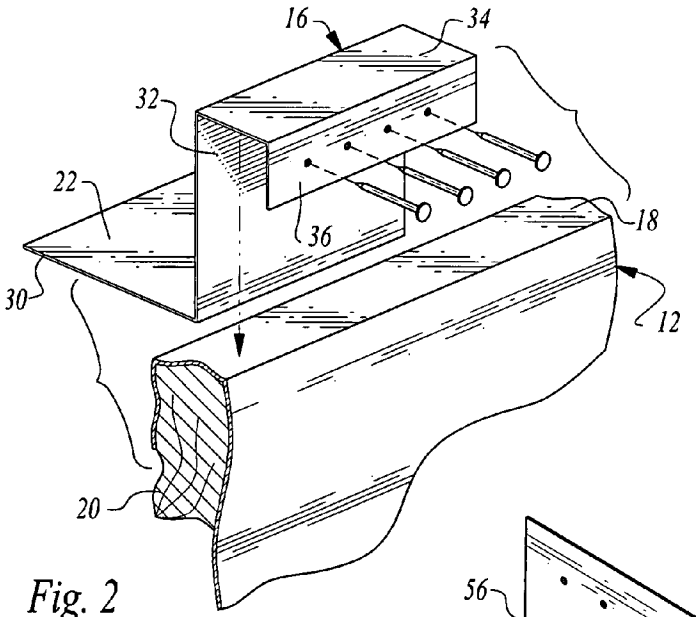
FIG. 2 is an enlarged, exploded, perspective view illustrating a portion of the frame of the air conditioner support prior to installation of a hold-down bracket.
Figure 4:
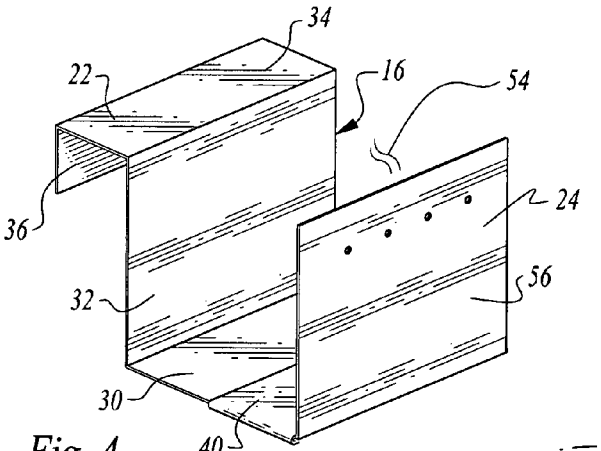
FIG. 4 is a perspective view of the assembled hold-down bracket.
Figure 5:
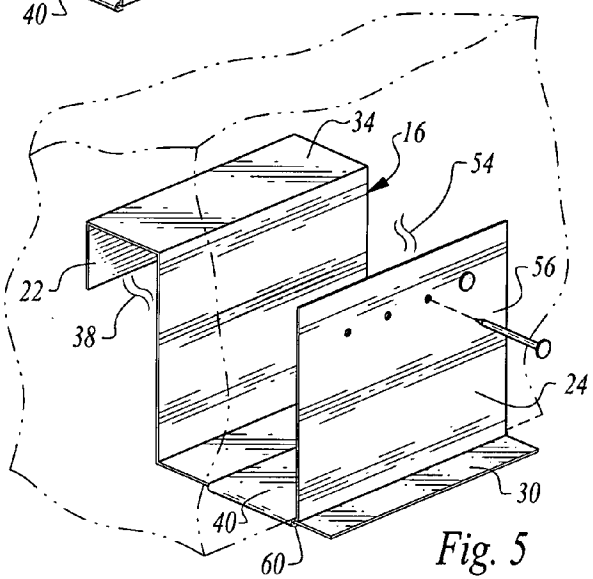
FIG. 5 is a view similar to FIG. 4, but illustrating the bracket adjusted to receive a portion of an air conditioner, shown in broken lines, with the bracket adjusted to conform to the dimensions of the air conditioner.
Figure 6:
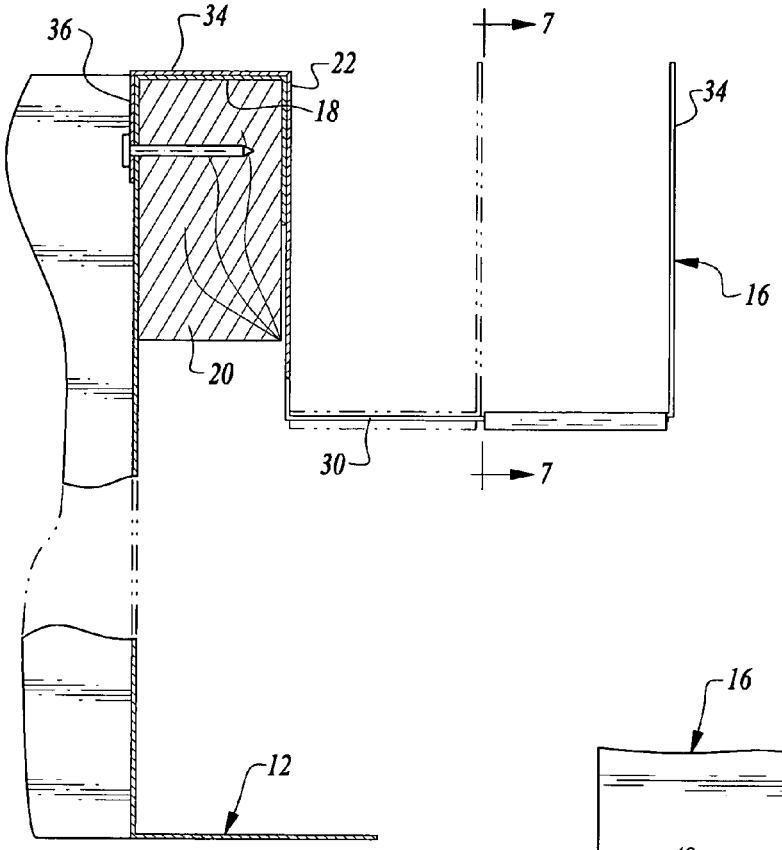
FIG. 6 is an enlarged, cross-sectional view taken along the line 6-6 of FIG. 1 and showing alternative relative positioning of the bracket members.
Figure 8:
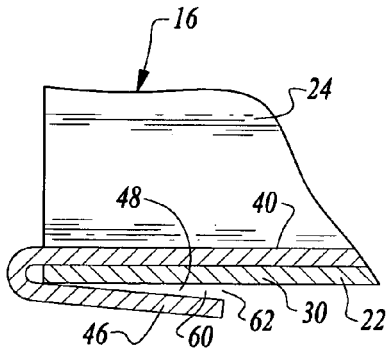
FIG. 8 is a greatly enlarged, cross-sectional view taken along the portion of the hold-down bracket delineated by the double-headed arrow 8-8 in FIG. 7.
Figure 7:
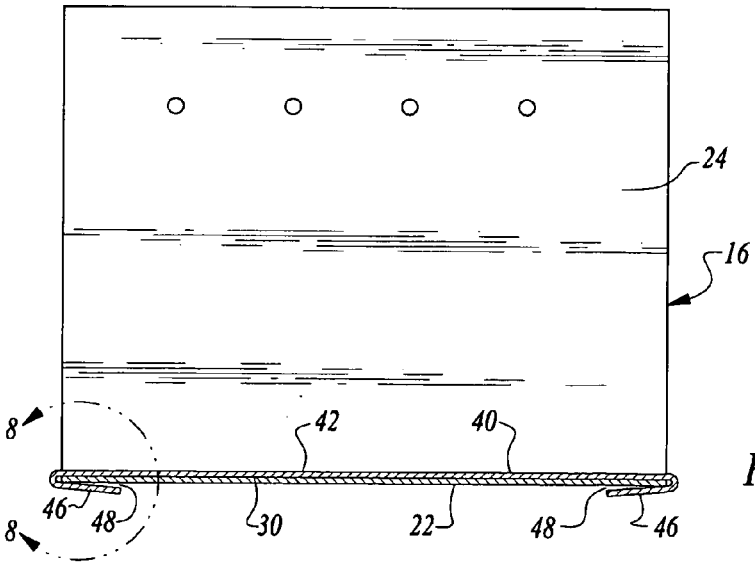
FIG. 7 is an enlarged, cross-sectional view taken along the line 7-7 of FIG. 6.

FIGS. 2-8 show all or portions of a single hold-down bracket 16. FIGS. 2 and 6 illustrate the bracket along with a portion of the roof air conditioner support frame 12. In this particular embodiment of the support, the frame includes a top peripheral flange or shoulder 18 having an inner wooden core 20, the rest of the support being formed of galvanized steel, aluminum or other suitable material.

The hold-down bracket 16 is suitably constructed of galvanized sheet metal, a material which is also employed in the manufacture of conventional hold-down brackets. The bracket 16 includes a first bracket member 22 for securement to the frame 12 and a second bracket member 24 for securement to the air conditioner 26 positioned on frame 12 and illustrated in dash lines in FIGS. 1 and 5.

Bracket member 22 includes a first bracket member flange 30. A bracket member panel 32 extends upwardly from the bracket member flange 30 and has a distal end. A bracket member shoulder panel 34 is integral with panel 32 and extends from the distal end thereof. A downwardly extending retention panel 36 is attached to the shoulder panel and spaced from the bracket member panel 32 to define a frame receiving space 38. Nail holes are formed in retention panel 36 and nails are utilized to secure bracket member 22 to the frame shoulder when the frame shoulder is positioned in space 38. FIG. 2 shows the bracket member 22 prior to installation and FIG. 6 shows the first bracket member 22 nailed in place on the frame shoulder 18.

Second bracket number 24 has a second bracket member flange 40 having a flange central portion 42 and two flange side portions folded over to form flange lip portions 46 under the flange central portion.

The flange lip portions 46 and the flange central portion 42 define recesses 48 extending the length of the flange lip portions, and the flange lip portions and the flange central portion further define spaced end openings 60 and elongated side openings 62 extending between the end openings. The flange lip portions 46 extend toward one another and diverge downwardly away from the flange central portion.

Figure 3:
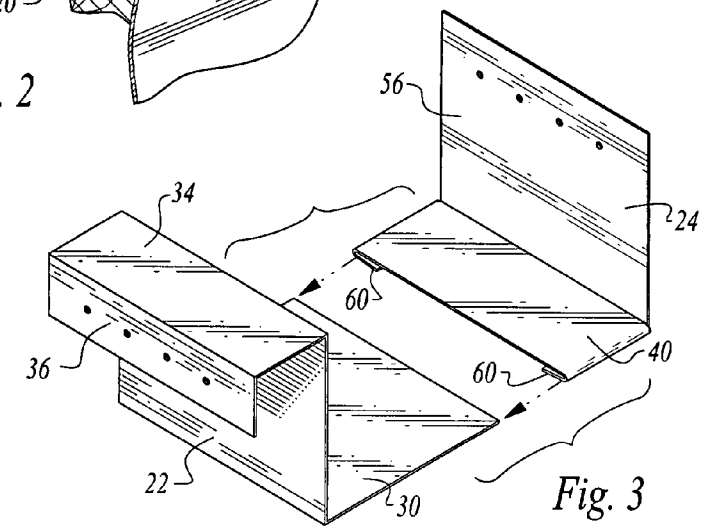
FIG. 3 is an exploded, perspective view illustrating first and second bracket members of the hold-down bracket prior to connection to one another.

FIG. 3 shows the position of the bracket members 22, 24 prior to assembly thereof. During assembly, the flange 30 is inserted into the recesses 48 of flange 40. This assembled condition is shown in FIG. 4. The flanges are slidably adjustable and the bracket members 22 and 24 jointly define an air conditioner receiving space 54 for receiving a portion of the air conditioner. This slidable adjustment feature, as is shown in FIG. 6, allows the size of the air conditioner receiving space 54 to be varied.

Nails or other suitable fasteners may be utilized to secure the upstanding plate 56 of the bracket member 24 attached to and extending upwardly from flange 40 to the side of the air conditioning unit as shown in FIG. 5. In this particular illustration, the distal end of first bracket member flange 30 extends completely through and beyond the lip portions 46 when the bracket member 24 is secured in place since flange 30 is longer than flange 40. Even though the bracket members 22, 24 are not directly fixedly attached together, the hold-down bracket 16 provides a rigid and secure attachment between the roof mounted air conditioner support and the air conditioner.

The invention claimed is:

1. In combination:

a roof mounted air conditioner support having a frame;

an air conditioner; and a hold-down bracket attached to the frame securing the air conditioner to said frame, said bracket including a first bracket member secured to the frame including a first bracket member flange, and a second bracket member secured to the air conditioner and including a second bracket member flange engaging said first bracket member flange and slidably adjustable relative to said first bracket member flange, one of said flanges defining at least one recess receiving the other of said flanges, said first bracket member and said second bracket member jointly defining an air conditioner receiving space receiving a portion of said air conditioner, said first and second bracket members formed of sheet metal and the sheet metal of the bracket member defining said at least one recess folded over to define two spaced recesses for receiving the other of said flanges.

2. The combination according to claim 1 wherein the bracket member defining said two spaced recesses includes a flange central portion and two flange side portions folded over to form flange lip portions under said flange central portion.

3. The combination according to claim 2 wherein said flange lip portions and said flange central portion define recesses extending the length of said flange lip portions and define end openings and elongated side openings between said end openings receiving the other of said flanges.

4. The combination according to claim 3 wherein said flange lip portions extend toward one another and diverge downwardly away from said flange central portion.

5. The combination according to claim 3 wherein the other of said flanges is longer than said recesses.

6. The combination according to claim 1 additionally including mechanical fasteners attaching said first bracket to the frame and the second bracket to the air conditioner to prevent movement between said first and second brackets.

7. In combination:

a roof mounted air conditioner support having a frame;

an air conditioner; and a hold-down bracket attached to the frame securing the air conditioner to said frame, said bracket including a first bracket member secured to the frame including a first bracket member flange, and a second bracket member secured to the air conditioner and including a second bracket member flange engaging said first bracket member flange and slidably adjustable relative to said first bracket member flange, said first bracket member and said second bracket member jointly defining an air conditioner receiving space receiving a portion of said air conditioner, said first bracket member additionally including a first bracket member panel extending upwardly from said first bracket member flange and having a distal end, a first bracket member shoulder panel affixed to said distal end, and a downwardly extending retention panel secured to said frame attached to said shoulder panel and spaced from said first bracket member panel to define a frame receiving space receiving said frame.

* * * * *